US011155082B2

(12) United States Patent
McClelland et al.

(10) Patent No.: US 11,155,082 B2
(45) Date of Patent: Oct. 26, 2021

(54) FLUID EJECTION DIE

(71) Applicant: HEWLETT-PACKARD DEVELOPMENT COMPANY, L.P., Spring, TX (US)

(72) Inventors: Sean P McClelland, Corvallis, OR (US); Jesse Rushen, Corvallis, OR (US); Larry H White, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 71 days.

(21) Appl. No.: 16/492,258

(22) PCT Filed: Apr. 24, 2017

(86) PCT No.: PCT/US2017/029140
§ 371 (c)(1),
(2) Date: Sep. 9, 2019

(87) PCT Pub. No.: WO2018/199896
PCT Pub. Date: Nov. 1, 2018

(65) Prior Publication Data

US 2021/0197561 A1 Jul. 1, 2021

(51) Int. Cl.
*B41J 2/14* (2006.01)
*B41J 2/16* (2006.01)

(52) U.S. Cl.
CPC .. *B41J 2/14* (2013.01); *B41J 2/16* (2013.01)

(58) Field of Classification Search
CPC ..... B41J 2/14; B41J 2/16
See application file for complete search history.

(56) References Cited

U.S. PATENT DOCUMENTS

| | | | |
|---|---|---|---|
| 6,565,195 | B2 | 5/2003 | Blair |
| 6,742,866 | B2 | 6/2004 | Anderson et al. |
| 6,908,172 | B2 | 6/2005 | Billow et al. |
| 7,618,119 | B2 | 11/2009 | Shibata et al. |
| 7,837,299 | B2 | 11/2010 | Mori |
| 2011/0128316 | A1 | 6/2011 | Delametter et al. |
| 2012/0056940 | A1 | 3/2012 | Masataka et al. |
| 2018/0015732 | A1 | 1/2018 | Chen |

(Continued)

FOREIGN PATENT DOCUMENTS

| | | |
|---|---|---|
| CN | 101376285 | 3/2009 |
| EP | 1264694 A1 | 12/2002 |

OTHER PUBLICATIONS

HP High Definition Nozzle Architecture, Jan. 11, 2017, <http://www8.hp.com/h20195/v2/GetPDF.aspx/4AA6-1075ENW.pdf >.

*Primary Examiner* — Lamson D Nguyen
(74) *Attorney, Agent, or Firm* — Dicke Billig & Czaja PLLC

(57) ABSTRACT

A fluid ejection die includes a fluid slot, laterally adjacent fluid ejection chambers each communicated with the fluid slot and having respective drop ejecting elements therein, and orifices each communicated with a respective one of the laterally adjacent fluid ejection chambers. The laterally adjacent fluid ejection chambers are spaced substantially a same distance from the fluid slot along a same side of the fluid slot, and the orifices communicated with the laterally adjacent fluid ejection chambers are spaced different distances from the fluid slot.

15 Claims, 5 Drawing Sheets

(56) References Cited

U.S. PATENT DOCUMENTS

| | | | | |
|---|---|---|---|---|
| 2018/0022106 | A1* | 1/2018 | Govyadinov | B41J 2/18<br>347/89 |
| 2018/0215147 | A1* | 8/2018 | Cumbie | B41J 2/155 |
| 2020/0079085 | A1* | 3/2020 | Govyadinov | B41J 2/175 |

* cited by examiner

FLUID EJECTION DIE

BACKGROUND

A fluid ejection die, such as a printhead die in an inkjet printing system, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead die and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
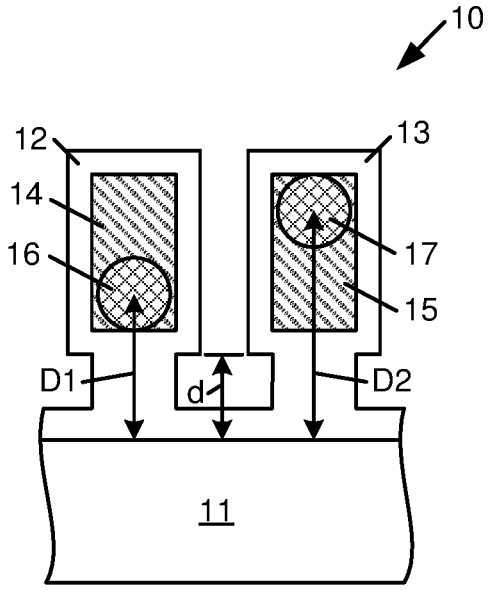
FIG. 1 is a schematic plan view illustrating an example of a portion of a fluid ejection die.

As illustrated in the example of FIG. 1, the present disclosure provides a fluid ejection die 10. In one implementation, the fluid ejection die includes a fluid slot 11, laterally adjacent fluid ejection chambers 12, 13 each communicated with the fluid slot and having respective drop ejecting elements 14, 15 therein, and orifices 16, 17 each communicated with a respective one of the laterally adjacent fluid ejection chambers, where the laterally adjacent fluid ejection chambers are spaced substantially a same distance (e.g., d) from the fluid slot along a same side of the fluid slot, and the orifices communicated with the laterally adjacent fluid ejection chambers are spaced different distances (e.g., D1, D2) from the fluid slot.

Figure 2:
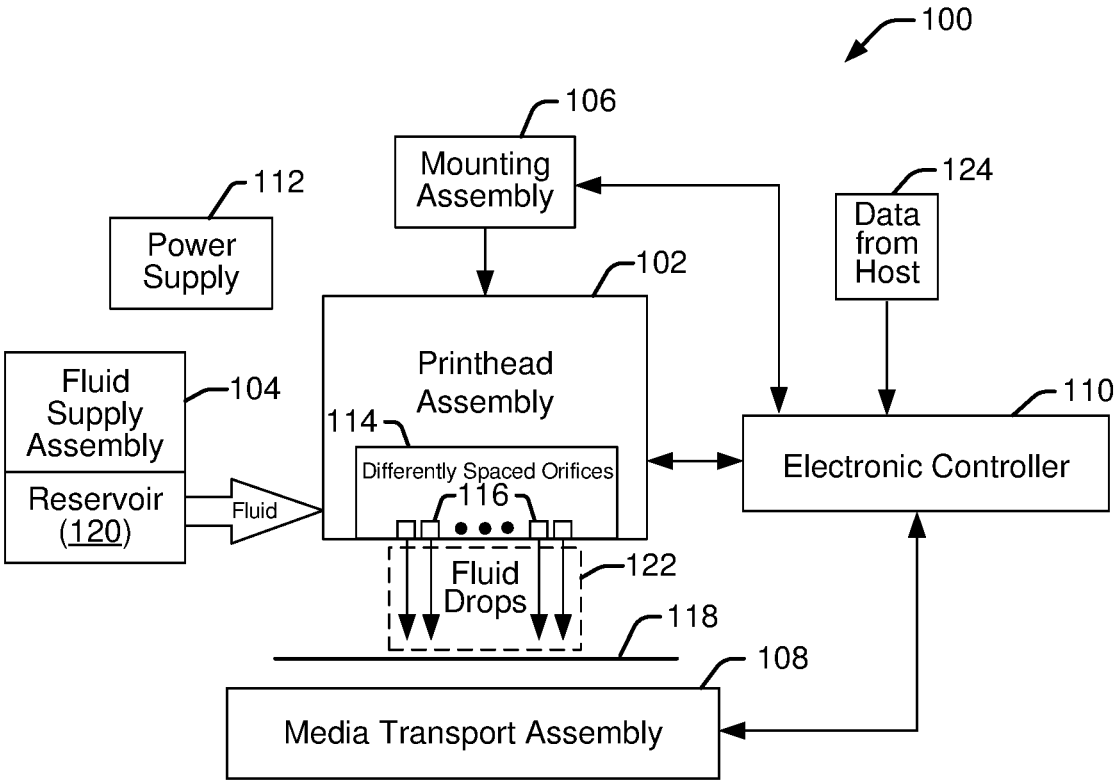
FIG. 2 is a block diagram illustrating an example of an inkjet printing system including an example of a fluid ejection die.

FIG. 2 illustrates an example of an inkjet printing system including an example of a fluid ejection die, as disclosed herein. Inkjet printing system 100 includes a printhead assembly 102, as an example of a fluid ejection assembly, a fluid (ink) supply assembly 104, a mounting assembly 106, a media transport assembly 108, an electronic controller 110, and at least one power supply 112 that provides power to the various electrical components of inkjet printing system 100. Printhead assembly 102 includes at least one printhead die 114, as an example of a fluid ejection die, that ejects drops of fluid (ink) through a plurality of nozzles or orifices 116 toward a print medium 118 so as to print on print media 118. In one implementation, orifices 116 are spaced different distances from a fluid feed slot.

Print media 118 can be any type of suitable sheet or roll material, such as paper, card stock, transparencies, Mylar, and the like, and may include rigid or semi-rigid material, such as cardboard or other panels. Nozzles or orifices 116 are typically arranged in one or more columns or arrays such that properly sequenced ejection of fluid (ink) from nozzles or orifices 116 causes characters, symbols, and/or other graphics or images to be printed on print media 118 as printhead assembly 102 and print media 118 are moved relative to each other.

Fluid (ink) supply assembly 104 supplies fluid (ink) to printhead assembly 102 and, in one example, includes a reservoir 120 for storing fluid such that fluid flows from reservoir 120 to printhead assembly 102. Fluid (ink) supply assembly 104 and printhead assembly 102 can form a one-way fluid delivery system or a recirculating fluid delivery system. In a one-way fluid delivery system, substantially all of the fluid supplied to printhead assembly 102 is consumed during printing. In a recirculating fluid delivery system, only a portion of the fluid supplied to printhead assembly 102 is consumed during printing. Fluid not consumed during printing is returned to fluid (ink) supply assembly 104.

In one example, printhead assembly 102 and fluid (ink) supply assembly 104 are housed together in an inkjet cartridge or pen. In another example, fluid (ink) supply assembly 104 is separate from printhead assembly 102 and supplies fluid (ink) to printhead assembly 102 through an interface connection, such as a supply tube. In either example, reservoir 120 of fluid (ink) supply assembly 104 may be removed, replaced, and/or refilled. Where printhead assembly 102 and fluid (ink) supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles or orifices 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of fluid (ink) drops from nozzles or orifices 116. Thus, electronic controller 110 defines a pattern of ejected fluid (ink) drops which form characters, symbols, and/or other graphics or images on print media 118. The pattern of ejected fluid (ink) drops is determined by the print job commands and/or command parameters.

Printhead assembly 102 includes one or more printhead dies 114. In one example, printhead assembly 102 is a wide-array or multi-head printhead assembly. In one implementation of a wide-array assembly, printhead assembly 102 includes a carrier that carries a plurality of printhead dies 114, provides electrical communication between printhead dies 114 and electronic controller 110, and provides fluidic communication between printhead dies 114 and fluid (ink) supply assembly 104.

In one example, inkjet printing system 100 is a drop-on-demand thermal inkjet printing system wherein printhead die 114 is a thermal inkjet (TIJ) printhead. The thermal inkjet printhead implements a thermal resistor ejection element in a fluid (ink) chamber to vaporize fluid (ink) and create bubbles that force fluid (ink) drops out of nozzles or orifices 116. In another example, inkjet printing system 100 is a drop-on-demand piezoelectric inkjet printing system wherein printhead die 114 is a piezoelectric inkjet (PIJ) printhead that implements a piezoelectric material actuator as an ejection element to generate pressure pulses that force fluid (ink) drops out of nozzles or orifices 116.

Figure 3:
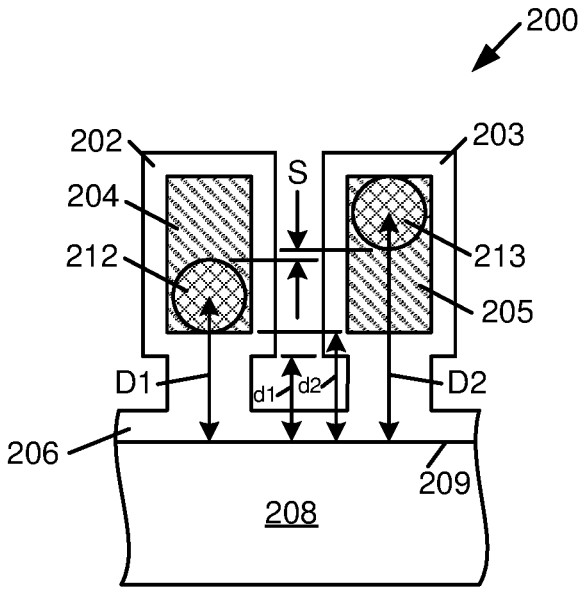
FIG. 3 is a schematic plan view illustrating an example of a portion of a fluid ejection die.

FIG. 3 is a schematic plan view illustrating an example of a portion of a fluid ejection die 200. Fluid ejection die 200 includes a first fluid ejection chamber 202 and a corresponding drop ejecting element 204 formed in, provided within, or communicated with fluid ejection chamber 202, and a second fluid ejection chamber 203 and a corresponding drop ejecting element 205 formed in, provided within, or communicated with fluid ejection chamber 203.

In one example, fluid ejection chambers 202 and 203 and drop ejecting elements 204 and 205 are formed on a substrate 206 which has a fluid (or ink) feed slot 208 formed therein such that fluid feed slot 208 provides a supply of fluid (or ink) to fluid ejection chambers 202 and 203 and drop ejecting elements 204 and 205. Fluid feed slot 208 includes, for example, a hole, passage, opening, convex geometry or other fluidic architecture formed in or through substrate 206 by which or through which fluid is supplied to fluid ejection chambers 202 and 203. Fluid feed slot 208 may include one (i.e., a single) or more than one (e.g., a series of) such hole, passage, opening, convex geometry or other fluidic architecture that communicates fluid with one (i.e., a single) or more than one fluid ejection chamber. Substrate 206 may be formed, for example, of silicon, glass, or a stable polymer.

In one example, fluid ejection chambers 202 and 203 are formed in or defined by a barrier layer (not shown) provided on substrate 206, such that fluid ejection chambers 202 and 203 each provide a "well" in the barrier layer. The barrier layer may be formed, for example, of a photoimageable epoxy resin, such as SUB. In one example, a nozzle or orifice layer (not shown) is formed or extended over the barrier layer such that nozzle openings or orifices 212 and 213 formed in the orifice layer communicate with respective fluid ejection chambers 202 and 203.

Drop ejecting elements 204 and 205 can be any device capable of ejecting fluid drops through corresponding nozzle openings or orifices 212 and 213. Examples of drop ejecting elements 204 and 205 include thermal resistors or piezoelectric actuators. A thermal resistor, as an example of a drop ejecting element, may be formed on a surface of a substrate (substrate 206), and may include a thin-film stack including an oxide layer, a metal layer, and a passivation layer such that, when activated, heat from the thermal resistor vaporizes fluid in corresponding fluid ejection chamber 202 or 203, thereby causing a bubble that ejects a drop of fluid through corresponding nozzle opening or orifice 212 or 213. A piezoelectric actuator, as an example of a drop ejecting element, generally includes a piezoelectric material provided on a moveable membrane communicated with corresponding fluid ejection chamber 202 or 203 such that, when activated, the piezoelectric material causes deflection of the membrane relative to corresponding fluid ejection chamber 202 or 203, thereby generating a pressure pulse that ejects a drop of fluid through corresponding nozzle opening or orifice 212 or 213. A variety of other devices, however, can also be used to implement drop ejecting elements 204 and 205 including, for example, a mechanical/impact driven membrane, an electrostatic (MEMS) membrane, a voice coil, a magneto-strictive drive, and others. In the example illustrated in FIG. 3, drop ejecting elements 204 and 205 are each thermal resistors. Each of the thermal resistors may include, for example, a single resistor, a split resistor, a comb resistor, or multiple resistors.

As illustrated in the example of FIG. 3, fluid ejection chambers 202 and 203 are laterally adjacent each other. More specifically, fluid ejection chambers 202 and 203 are provided next to each other along a same side of fluid feed slot 208.

In one example, as illustrated in FIG. 3, orifices 212 and 213, as communicated with laterally adjacent fluid ejection chambers 202 and 203, are offset or staggered relative to each other. More specifically, a distance between a respective center of orifices 212 and 213 and a side or edge 209 of fluid feed slot 208 varies. For example, orifice 212 is spaced a distance D1 from edge 209, and orifice 213 is spaced a distance D2 from edge 209. In one example, distance D2 is greater than distance D1 such that orifices 212 and 213 are spaced varying distances from fluid feed slot 208. As such, laterally adjacent orifices of fluid ejection die 200, such as orifices 212 and 213, are staggered relative to fluid feed slot 208.

As illustrated in the example of FIG. 3, although orifices 212 and 213 are offset or staggered relative to each other, laterally adjacent fluid ejection chambers 202 and 203 are substantially aligned with each other. More specifically, a distance between respective fluid ejection chambers 202 and 203 and edge 209 of fluid feed slot 208 is substantially the same. For example, fluid ejection chamber 202 is spaced a distance d1 from edge 209, and fluid ejection chamber 203 is spaced the same distance d1 from edge 209. As such, laterally adjacent fluid ejection chambers 202 and 203 are spaced substantially a same distance from fluid feed slot 208, while respective orifices 212 and 213 are spaced different distances from fluid feed slot 208.

In one example, a respective center of orifices 212 and 213 is offset relative to a center of respective fluid ejection chambers 202 and 203. More specifically, a respective center of orifices 212 and 213 is offset toward or away from fluid feed slot 208 relative to a center of respective fluid ejection chambers 202 and 203. For example, as illustrated in the example of FIG. 3, a center of orifice 212 is offset toward fluid feed slot 208 relative to a center of fluid ejection chamber 202, and a center of orifice 213 is offset away from fluid feed slot 208 relative to a center of fluid ejection chamber 203.

As illustrated in the example of FIG. 3, although orifices 212 and 213 are offset or staggered relative to each other, drop ejecting elements 204 and 205 of laterally adjacent fluid ejection chambers 202 and 203 are substantially aligned with each other. More specifically, a distance between respective drop ejecting elements 204 and 205 and edge 209 of fluid feed slot 208 is substantially the same. For example, drop ejecting element 204 of fluid ejection chamber 202 is spaced a distance d2 from edge 209, and drop ejecting element 205 of fluid ejection chamber 203 is spaced the same distance d2 from edge 209. As such, drop ejecting elements 204 and 205 are spaced substantially a same distance from fluid feed slot 208, while respective orifices 212 and 213 are spaced different distances from fluid feed slot 208.

In one example, a respective center of orifices 212 and 213 is offset relative to a center of respective drop ejecting elements 204 and 205. More specifically, a respective center of orifices 212 and 213 is offset toward or away from fluid feed slot 208 relative to a center of respective drop ejecting elements 204 and 205. For example, as illustrated in the example of FIG. 3, a center of orifice 212 is offset toward fluid feed slot 208 relative to a center of drop ejecting element 204, and a center of orifice 213 is offset away from fluid feed slot 208 relative to a center of drop ejecting element 205.

In one example, as illustrated in FIG. 3, orifices 212 and 213, as communicated with laterally adjacent fluid ejection chambers 202 and 203, are offset or staggered relative to each other such that orifices 212 and 213 do not overlap in a lateral direction. More specifically, an offset spacing S (letter "S") is provided between orifices 212 and 213.

Figure 4:
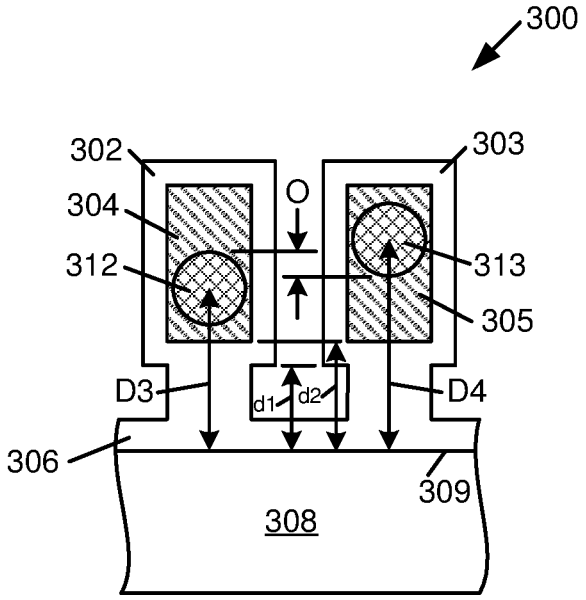
FIG. 4 is a schematic plan view illustrating an example of a portion of a fluid ejection die.

FIG. 4 is a schematic plan view illustrating an example of a portion of a fluid ejection die 300. Similar to fluid ejection die 200, fluid ejection die 300 includes a first fluid ejection chamber 302 with a corresponding drop ejecting element 304, and a second fluid ejection chamber 303 with a corresponding drop ejecting element 305, such that nozzle openings or orifices 312 and 313 communicate with respective fluid ejection chambers 302 and 303.

In one example, and similar to fluid ejection chambers 202 and 203 and drop ejecting elements 204 and 205, fluid ejection chambers 302 and 303 and drop ejecting elements 304 and 305 are formed on a substrate 306 which has a fluid (or ink) feed slot 308 formed therein such that fluid feed slot 308 provides a supply of fluid (or ink) to fluid ejection chambers 302 and 303 and drop ejecting elements 304 and 305. In addition, fluid ejection chambers 302 and 303 are formed in or defined by a barrier layer (not shown) provided on substrate 306, and a nozzle or orifice layer (not shown) is formed or extended over the barrier layer such that nozzle openings or orifices 312 and 313 formed in the orifice layer communicate with respective fluid ejection chambers 302 and 303. Similar to drop ejecting elements 204 and 205, drop ejecting elements 304 and 305 can be any device capable of ejecting fluid drops through corresponding nozzle openings or orifices 312 and 313. In the example illustrated in FIG. 4, drop ejecting elements 304 and 305 are each thermal resistors.

As illustrated in the example of FIG. 4, fluid ejection chambers 302 and 303 are laterally adjacent each other. More specifically, fluid ejection chambers 302 and 303 are provided next to each other along a same side of fluid feed slot 308.

In one example, as illustrated in FIG. 4, orifices 312 and 313, as communicated with laterally adjacent fluid ejection chambers 302 and 303, are offset or staggered relative to each other. More specifically, a distance between a respective center of orifices 312 and 313 and an edge 309 of fluid feed slot 308 varies. For example, orifice 312 is spaced a distance D3 from edge 309, and orifice 313 is spaced a distance D4 from edge 309. In one example, distance D4 is greater than distance D3 such that orifices 312 and 313 are spaced varying distances from fluid feed slot 308. As such, laterally adjacent orifices of fluid ejection die 300, such as orifices 312 and 313, are staggered relative to fluid feed slot 308.

As illustrated in the example of FIG. 4, although orifices 312 and 313 are offset or staggered relative to each other, laterally adjacent fluid ejection chambers 302 and 303 are substantially aligned with each other. More specifically, a distance between respective fluid ejection chambers 302 and 303 and edge 309 of fluid feed slot 308 is substantially the same. For example, fluid ejection chamber 302 is spaced a distance d1 from edge 309, and fluid ejection chamber 303 is spaced the same distance d1 from edge 309. As such, laterally adjacent fluid ejection chambers 302 and 303 are spaced substantially a same distance from fluid feed slot 308, while respective orifices 312 and 313 are spaced different distances from fluid feed slot 308.

In one example, a respective center of orifices 312 and 313 is offset relative to a center of respective fluid ejection chambers 302 and 303. More specifically, a respective center of orifices 312 and 313 is offset toward or away from fluid feed slot 308 relative to a center of respective fluid ejection chambers 302 and 303. For example, as illustrated in the example of FIG. 4, a center of orifice 312 is offset toward fluid feed slot 308 relative to a center of fluid ejection chamber 302, and a center of orifice 313 is offset away from fluid feed slot 308 relative to a center of fluid ejection chamber 303.

As illustrated in the example of FIG. 4, although orifices 312 and 313 are offset or staggered relative to each other, drop ejecting elements 304 and 305 of laterally adjacent fluid ejection chambers 302 and 303 are substantially aligned with each other. More specifically, a distance between respective drop ejecting elements 304 and 305 and edge 309 of fluid feed slot 308 is substantially the same. For example, drop ejecting element 304 of fluid ejection chamber 302 is spaced a distance d2 from edge 309, and drop ejecting element 305 of fluid ejection chamber 303 is spaced the same distance d2 from edge 309. As such, drop ejecting elements 304 and 305 are spaced substantially a same distance from fluid feed slot 308, while respective orifices 312 and 313 are spaced different distances from fluid feed slot 308.

In one example, a respective center of orifices 312 and 313 is offset relative to a center of respective drop ejecting elements 304 and 305. More specifically, a respective center of orifices 312 and 313 is offset toward or away from fluid feed slot 308 relative to a center of respective drop ejecting elements 304 and 305. For example, as illustrated in the example of FIG. 3, a center of orifice 312 is offset toward fluid feed slot 308 relative to a center of drop ejecting element 304, and a center of orifice 313 is offset away from fluid feed slot 308 relative to a center of drop ejecting element 305.

In one example, as illustrated in FIG. 4, orifices 312 and 313, as communicated with laterally adjacent fluid ejection chambers 302 and 303, are offset or staggered relative to each other such that orifices 312 and 313 partially overlap in a lateral direction. More specifically, an offset overlap O (letter "O") is provided between orifices 312 and 313.

Figure 5:
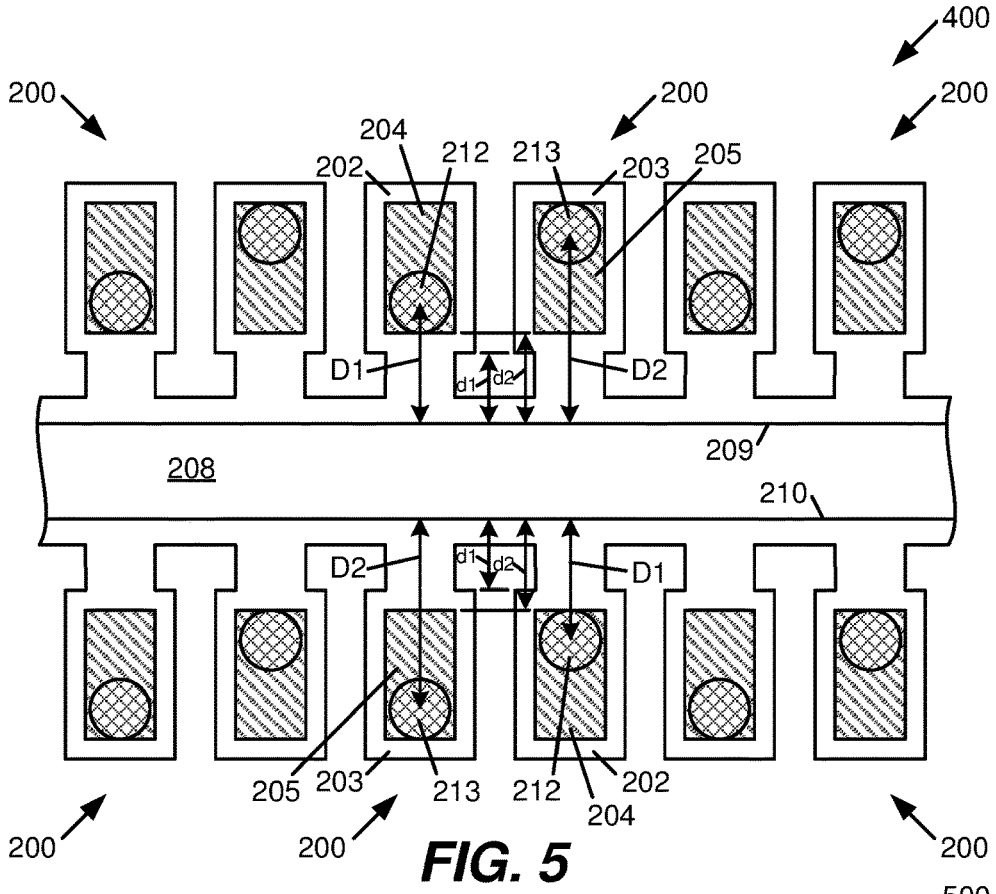
FIG. 5 is a schematic plan view illustrating an example of a portion of a fluid ejection die.

FIG. 5 is a schematic plan view illustrating an example of a portion of a fluid ejection die 400. In one example, fluid ejection die 400 includes an array of fluid ejection dies, such as an array of fluid ejection dies 200, as illustrated in FIG. 3 and described above.

In one example, fluid ejection dies 200 of fluid ejection die 400 are arranged along a length of fluid feed slot 208 on opposite sides of fluid feed slot 208 such that corresponding nozzle openings or orifices 212 and 213 of fluid ejection dies 200 are arranged in parallel (substantially parallel) columns (or arrays). In addition, fluid ejection dies 200 on opposite sides of fluid feed slot 208 are shifted relative to each other such that orifice 212 on one side of fluid feed slot 208 is aligned with and opposite orifice 213 on an opposite side of fluid feed slot 208.

As illustrated in the example of FIG. 5, fluid feed slot 208 is substantially straight and includes opposite sides or edges 209 and 210 oriented substantially parallel with each other. As such, fluid ejection chambers 202 and 203 of respective fluid ejection dies 200 are spaced substantially the same distance d1 from respective edges 209 and 210 of fluid feed slot 208 (in opposite directions). In addition, drop ejecting elements 204 and 205 of respective fluid ejection dies 200 are spaced substantially the same distance d2 from respective edges 209 and 210 of fluid feed slot 208 (in opposite directions).

In one example, as illustrated in FIG. 5, aligned orifices 212 and 213 of respective fluid ejection dies 200 on opposite sides of fluid feed slot 208 are spaced different distances from fluid feed slot 208 in opposite directions. For example, orifice 212 on one side of fluid feed slot 208 is spaced distance D1 from edge 209 in one direction, and aligned, opposite orifice 213 on an opposite side of fluid feed slot 208 is spaced distance D2 from edge 210 in an opposite direction. In addition, orifice 213 on one side of fluid feed slot 208 is spaced distance D2 from edge 209 in one direction, and aligned, opposite orifice 212 on an opposite side of fluid feed slot 208 is spaced distance D1 from edge 210 in an opposite direction.

Figure 6:
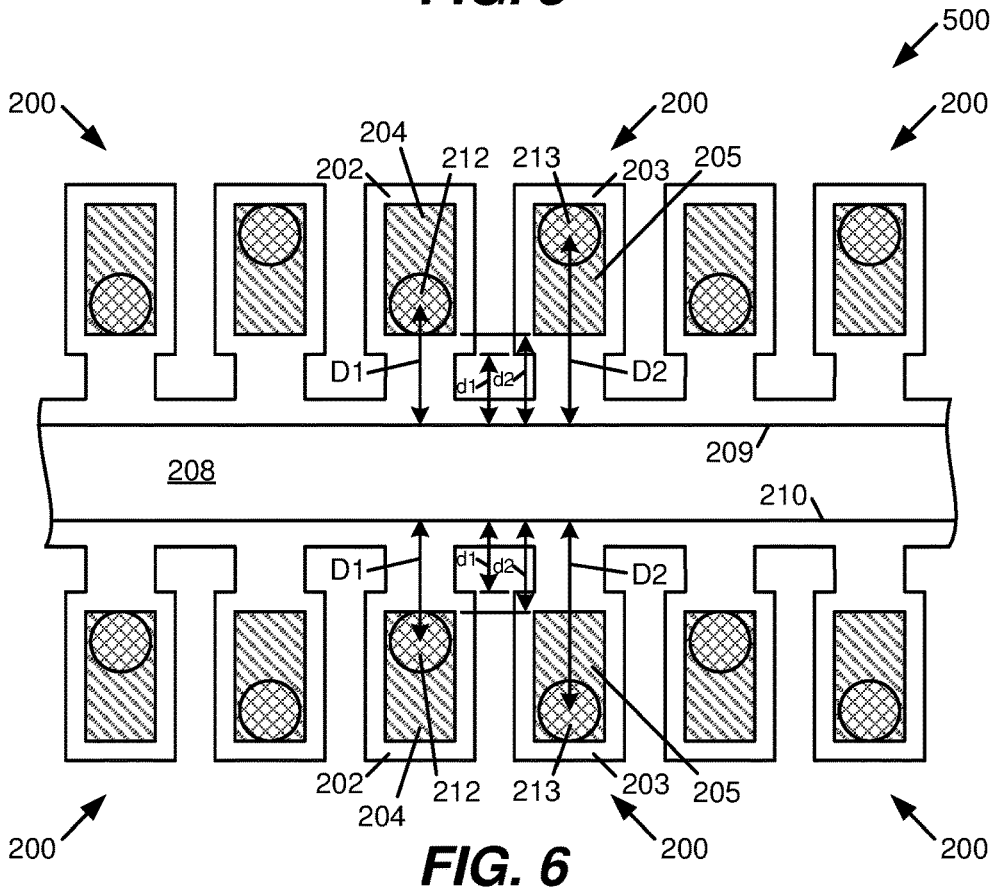
FIG. 6 is a schematic plan view illustrating an example of a portion of a fluid ejection die.

FIG. 6 is a schematic plan view illustrating an example of a portion of a fluid ejection die 500. In one example, similar to fluid ejection die 400, fluid ejection die 500 includes an array of fluid ejection dies, such as an array of fluid ejection dies 200, as illustrated in FIG. 3 and described above.

In one example, fluid ejection dies 200 of fluid ejection die 500 are arranged along a length of fluid feed slot 208 on opposite sides of fluid feed slot 208 such that corresponding nozzle openings or orifices 212 and 213 of fluid ejection dies 200 are arranged in parallel (substantially parallel) columns (or arrays). In addition, fluid ejection dies 200 on opposite sides of fluid feed slot 208 are aligned with each other such that orifices 212 and 213 of respective fluid ejection dies 200 on opposite sides of fluid feed slot 208 are aligned with and opposite each other across fluid feed slot 208. More specifically, orifice 212 on one side of fluid feed slot 208 is aligned with and opposite orifice 212 on an opposite side of fluid feed slot 208, and orifice 213 on one side of fluid feed slot 208 is aligned with and opposite orifice 213 on an opposite side of fluid feed slot 208.

As illustrated in the example of FIG. 6, fluid feed slot 208 is substantially straight and includes opposite sides or edges 209 and 210 oriented substantially parallel with each other. As such, fluid ejection chambers 202 and 203 of respective fluid ejection dies 200 are spaced substantially the same distance d1 from respective edges 209 and 210 of fluid feed slot 208 (in opposite directions). In addition, drop ejecting elements 204 and 205 of respective fluid ejection dies 200 are spaced substantially the same distance d2 from respective edges 209 and 210 of fluid feed slot 208 (in opposite directions).

In one example, as illustrated in FIG. 6, aligned orifices 212 and 213 of respective fluid ejection dies 200 on opposite sides of fluid feed slot 208 are spaced substantially a same distance from fluid feed slot 208 in opposite directions. For example, orifice 212 on one side of fluid feed slot 208 is spaced distance D1 from edge 209 in one direction, and aligned, opposite orifice 212 on an opposite side of fluid feed slot 208 is spaced the same distance D1 from edge 210 in an opposite direction. In addition, orifice 213 on one side of fluid feed slot 208 is spaced distance D2 from edge 209 in one direction, and aligned, opposite orifice 213 on an opposite side of fluid feed slot 208 is spaced the same distance D2 from edge 210 in an opposite direction.

Figure 7:
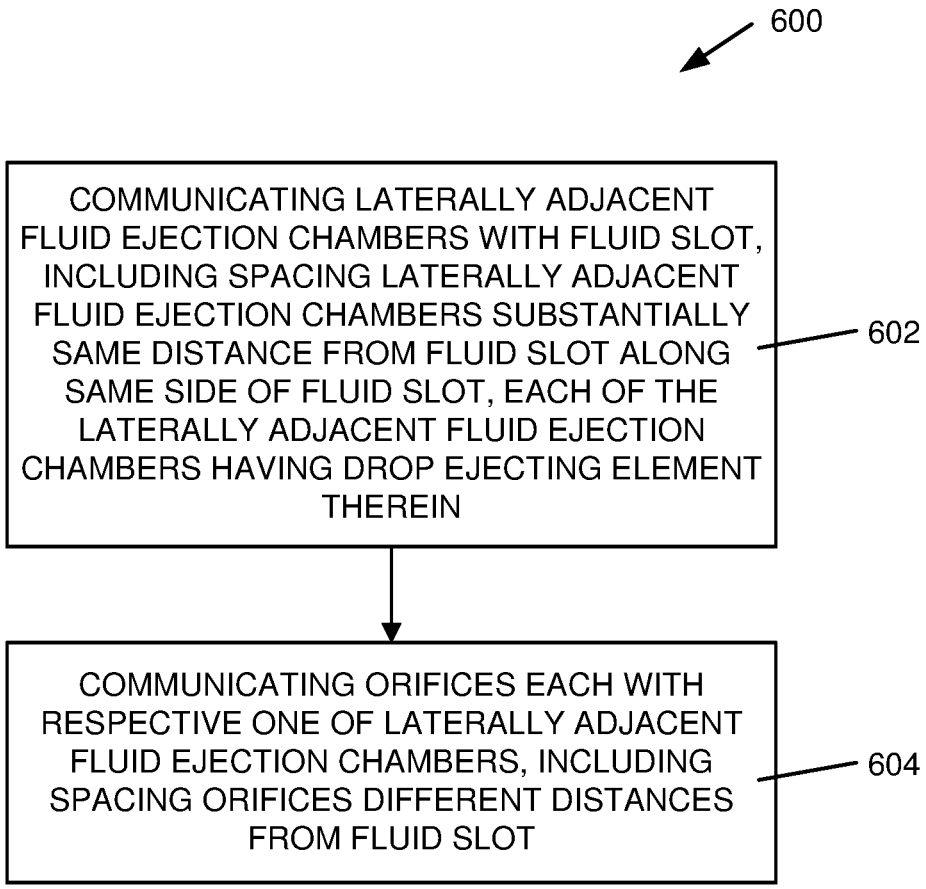
FIG. 7 is a flow diagram illustrating an example of a method of forming a fluid ejection die.

FIG. 7 is a flow diagram illustrating an example of a method 600 of forming a fluid ejection die, such as fluid ejection dies 200, 300 as illustrated in the respective examples of FIGS. 3, 4.

At 602, method 600 includes communicating laterally adjacent fluid ejection chambers with a fluid slot, with each of the laterally adjacent fluid ejection chambers having a drop ejecting element therein, such as communicating fluid ejection chambers 202/203, 302/303 with respective fluid feed slots 208, 308, with fluid ejection chambers 202/203, 302/303 including respective drop ejecting elements 204/205, 304/305.

In one example, communicating laterally adjacent fluid ejection chambers with a fluid slot, at 602, includes spacing the laterally adjacent fluid ejection chambers substantially a same distance from the fluid slot along a same side of the fluid slot, such as spacing fluid ejection chambers 202/203, 302/303 distance d1 from respective fluid feed slots 208, 308.

At 604, method 600 includes communicating orifices each with a respective one of the laterally adjacent fluid ejection chambers, such as communicating orifices 212/213, 312/313 with respective fluid ejection chambers 202/203, 302/303.

In one example, communicating orifices each with a respective one of the laterally adjacent fluid ejection chambers, at 604, includes spacing the orifices different distances from the fluid slot, such as spacing orifices 212/213, 312/313 respective different distances D1/D2, D3/D4 from respective fluid feed slots 208, 308.

As disclosed herein, orifices of laterally adjacent fluid ejection chambers, such as orifices 212/213, 312/313 as communicated with respective laterally adjacent fluid ejection chambers 202/203, 302/303, are offset or staggered relative to each other. Offsetting laterally adjacent orifices relative to each other increases the amount of material between orifices (as compared to orifices that are laterally aligned), and helps to decrease stress between adjacent orifices. In addition, staggering orifices relative to the fluid feed slot, such as fluid feed slots 208, 308, helps to reduce stress at the fluid feed slot.

Example fluid ejection dies, as described herein, may be implemented in printing devices, such as two-dimensional printers and/or three-dimensional printers (3D). As will be appreciated, some example fluid ejection dies may be printheads. In some examples, a fluid ejection die may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection die, comprising:

a fluid slot;

laterally adjacent fluid ejection chambers each communicated with the fluid slot and having respective drop ejecting elements therein; and orifices each communicated with a respective one of the laterally adjacent fluid ejection chambers, the laterally adjacent fluid ejection chambers spaced substantially a same distance from the fluid slot along a same side of the fluid slot, and the orifices communicated with the laterally adjacent fluid ejection chambers spaced different distances from the fluid slot.

2. The fluid ejection die of claim 1, wherein a respective center of one of the orifices communicated with the laterally adjacent fluid ejection chambers is offset toward the fluid slot relative to a center of a respective one of the laterally adjacent fluid ejection chambers.

3. The fluid ejection die of claim 1, wherein a respective center of one of the orifices communicated with the laterally adjacent fluid ejection chambers is offset away from the fluid slot relative to a center of a respective one of the laterally adjacent fluid ejection chambers.

4. The fluid ejection die of claim 1, wherein the fluid slot has a substantially linear edge, wherein the laterally adjacent fluid ejection chambers are spaced substantially a same distance from the substantially linear edge of the fluid slot along the same side of the fluid slot, wherein the orifices communicated with the laterally adjacent fluid ejection chambers are spaced different distances from the substantially linear edge of the fluid slot.

5. The fluid ejection die of claim 1, wherein the orifices communicated with the laterally adjacent fluid ejection chambers partially overlap in a lateral direction.

6. The fluid ejection die of claim 1, wherein the orifices communicated with the laterally adjacent fluid ejection chambers do not overlap in a lateral direction.

7. The fluid ejection die of claim 1, wherein the laterally adjacent fluid ejection chambers comprise a first plurality of laterally adjacent fluid ejection chambers spaced substantially a same distance from the fluid slot along a first side of the fluid slot and a second plurality of laterally adjacent fluid ejection chambers spaced substantially a same distance from the fluid slot along a second side of the fluid slot opposite the first side of the fluid slot.

8. The fluid ejection die of claim 7, wherein orifices communicated with the first plurality of laterally adjacent fluid ejection chambers and orifices communicated with the second plurality of laterally adjacent fluid ejection chambers opposite of each other across the fluid slot are spaced different distances from the fluid slot in opposite directions.

9. The fluid ejection die of claim 7, wherein orifices communicated with the first plurality of laterally adjacent fluid ejection chambers and orifices communicated with the second plurality of laterally adjacent fluid ejection chambers opposite of each other across the fluid slot are spaced substantially a same distance from the fluid slot in opposite directions.

10. The fluid ejection die of claim 1, wherein the drop ejecting elements of the laterally adjacent fluid ejection chambers are spaced substantially a same distance from the fluid slot along the same side of the fluid slot.

11. A fluid ejection die, comprising:

a fluid slot;

a first fluid ejection chamber communicated with the fluid slot;

a first orifice communicated with the first fluid ejection chamber;

a second fluid ejection chamber communicated with the fluid slot; and a second orifice communicated with the second fluid ejection chamber, the first fluid ejection chamber and the second fluid ejection chamber laterally adjacent to each other and spaced substantially a same distance from the fluid slot along a same side of the fluid slot, the first orifice and the second orifice spaced different distances from the fluid slot.

12. The fluid ejection die of claim 11, wherein, relative to a center of a respective one of the first fluid ejection chamber and the second fluid ejection chamber, a center of at least one of the first orifice and the second orifice is offset one of toward and away from the fluid slot.

13. A method of forming a fluid ejection die, comprising:

communicating laterally adjacent fluid ejection chambers with a fluid slot, including spacing the laterally adjacent fluid ejection chambers substantially a same distance from the fluid slot along a same side of the fluid slot, each of the laterally adjacent fluid ejection chambers having a drop ejecting element therein; and communicating orifices each with a respective one of the laterally adjacent fluid ejection chambers, including spacing the orifices different distances from the fluid slot.

14. The method of claim 13, wherein spacing the orifices different distances from the fluid slot includes, relative to a center of a respective one of the laterally adjacent fluid ejection chambers, offsetting a respective center of at least one of the orifices one of toward and away from the fluid slot.

15. The method of claim 13, wherein spacing the orifices different distances from the fluid slot includes, relative to a center of a respective one of the laterally adjacent fluid ejection chambers, offsetting a respective center of the orifice of one of the laterally adjacent fluid ejection chambers toward the fluid slot and offsetting a respective center of the orifice of another of the laterally adjacent fluid ejection chambers away from the fluid slot.

* * * * *